United States Patent [19]

Ooyachi

[11] 4,007,508

[45] Feb. 15, 1977

[54] MANUAL FLOOR SWEEPER

[75] Inventor: Akio Ooyachi, Tokyo, Japan

[73] Assignee: Hiroshi Watanabe, Tokyo, Japan

[22] Filed: Dec. 2, 1975

[21] Appl. No.: 636,967

[30] Foreign Application Priority Data

Dec. 3, 1974 Japan ..... 49-146390[U]

[52] U.S. Cl. ..... 15/42

[51] Int. Cl.[2] ..... A47L 11/33

[58] Field of Search ..... 15/41 R, 41 A, 42–45, 15/48, 49 C, 79 R

[56] References Cited

UNITED STATES PATENTS

| | | | |
|---|---|---|---|
| 2,783,487 | 3/1957 | Luders | 15/41 A |
| 3,950,809 | 4/1976 | Schatzmann | 15/41 A X |

*Primary Examiner*—Edward L. Roberts

*Attorney, Agent, or Firm*—Harold L. Stowell

[57] ABSTRACT

Herein disclosed is a manual floor sweeper including a casing, a pair of front and a pair of rear wheels and a pair of roll brush brooms juxtaposed longitudinally in parallel with each other in a manner to rotate inwardly in response to the rotation of the wheels so as to sweep up the dust on the floor into the hollow space of the casing. Two substantially enclosed housings are juxtaposed to each other at the both sides of the casing. Each of two gear trains is accommodated in each of the housings and includes a pair of drive gears, a pair of brush actuating gears, and a pair of coactive gears. A selective means is interposed between the drive gears and the brush actuating gears for selectively effecting power transmission between them, so that, in accordance with the forward and backward movements of the floor sweeper, the drive power from the drive gears, which are located at a front position with respect to the direction of advance of the floor sweeper, may be transmitted to the adjacent brush actuating gears by way of the selective means and further to the brush actuating gears of the far side by way of the coactive gears, thus allowing the drive gears in the rear position to rotate idly.

6 Claims, 14 Drawing Figures

MANUAL FLOOR SWEEPER

BACKGROUND OF THE INVENTION

1. Field of the Invention

The present invention relates generally to a floor sweeper of manual type, and more particularly to a floor sweeper of the type, in which two parallel roll brush brooms are made to rotate inwardly by means of gear trains accommodated in two juxtaposed housings of enclosed type.

2. Description of the Prior Art

As is well known in the art, most of the conventional floor sweepers of manual type have employed one brush brooms, with the resultant drawback that the dust on the floor can not be swept up completely. In order to eliminate this drawback, an improved floor sweeper has been developed using two brush brooms, as in Japanese Patent Publication No. 72 – 10679 or in Japanese Utility Model Publication No. 71 – 9329. With these developments, the above problem has been solved tentatively.

In the invention of Japanese Patent Publication No. 72 – 10679, however, such new drawbacks come out that the sweeping performance is deteriorated abruptly as a result of wear of the wheels due to use for a prolonged time period because the roll brush brooms are made to rotate by their frictional engagements with the wheels, and that the floor sweeper can not sweep up the dust of smaller size on the floor because its roll brush broom at the rear side is rotating above the floor although the front broom is rotating on the floor. This deterioration in the sweeping performance is not effected in the floor sweeper of Japanese Utility Model Publication 71 – 9329, since its roll brush brooms are made to rotate by means of a gear mechanism. In this floor sweeper, however, one roll brush broom is driven by a single wheel, and the resistances to the front and rear brooms are varied at all times. Thus, such an unbalanced condition is established as is effected in the unbalanced braking effect on an automobile or the like, with the resultant new drawback that the floor sweeper can not run stably. Since, moreover, the gear mechanism is not accommodated in an enclosed housing, it often becomes inoperable due to invasion of the dust. Especially, since the main shaft supporting the two wheels is positioned above the roll brush brooms, the waste pieces of thread, which are swept up by the brooms, are liable to twine themselves about the main shaft, as in the other conventional floor sweepers. The resultant drawbacks are that the roll brush brooms are damaged and that the main shaft is prevented from rotating smoothly.

SUMMARY OF THE INVENTION

It is, therefore, an object of the present invention to provide an improved floor sweeper of manual type, which is free from the afore-mentioned drawbacks and which can run stably while accomplishing its sweeping operation smoothly.

BRIEF DESCRIPTION OF THE DRAWINGS

Other objects and advantages of the present invention will become apparent from the following description taken in conjunction with the accompanying drawings, in which:

FIGS. 3A and 3B to 6A to 6B are a series of diagrammatic views showing the construction and assembly of the housing and the gear trains of the floor sweeper;

DESCRIPTION OF THE PREFERRED EMBODIMENT

Figure 1:
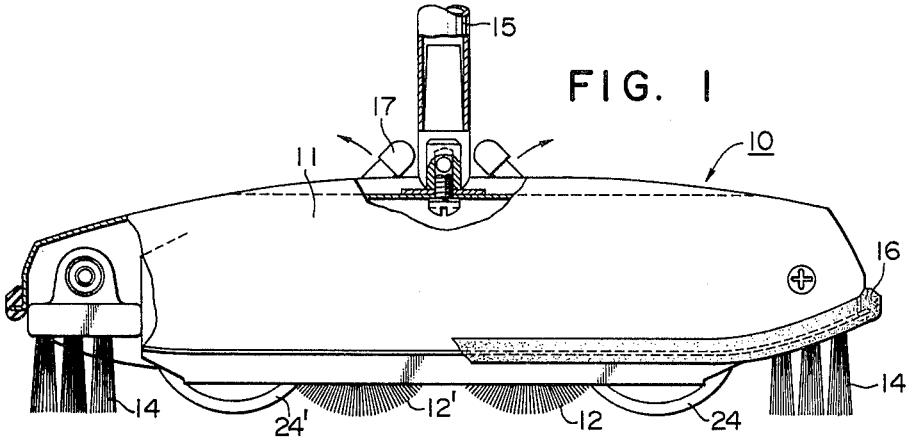
FIG. 1 is a side elevation showing a manual floor sweeper exemplifying the present invention, with portions being partially removed.
Figure 2:
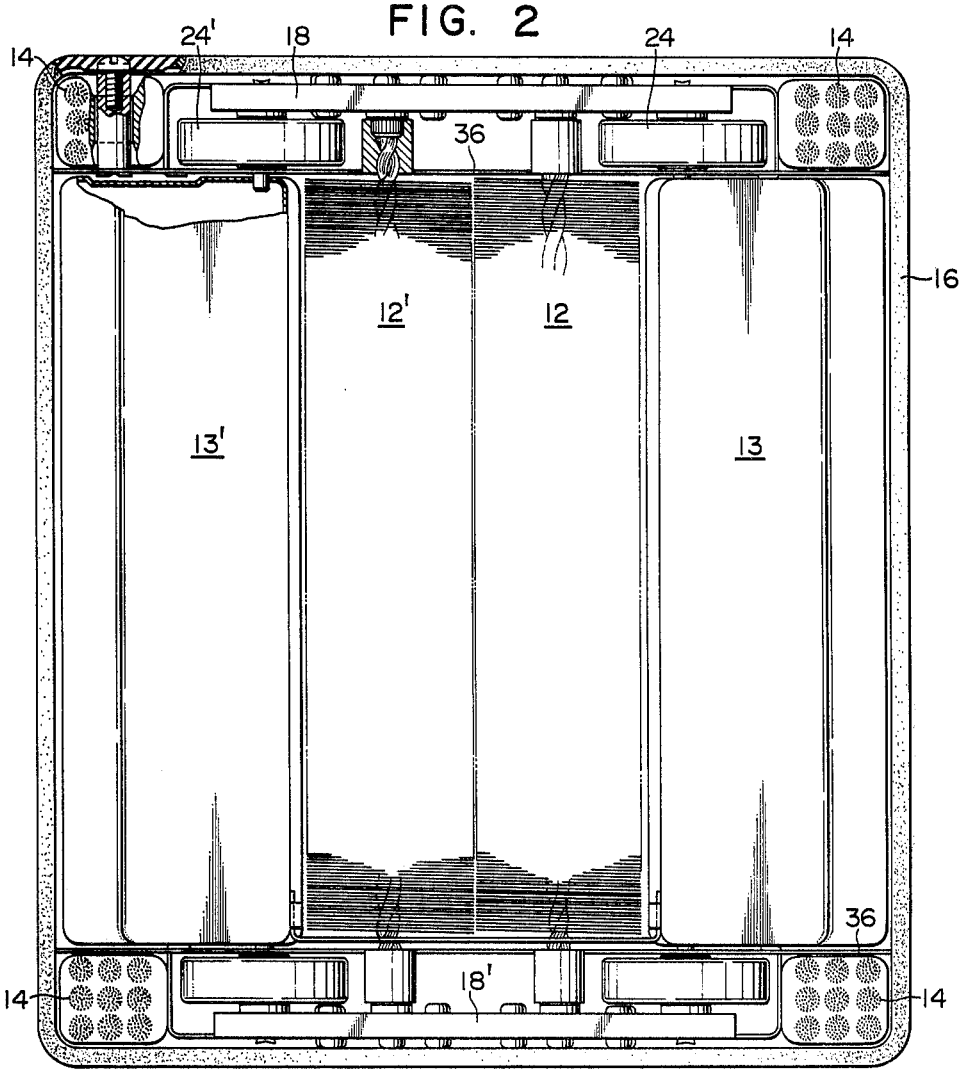
FIG. 2 is a bottom view showing the floor sweeper with portions being removed.

Generally indicated at reference numeral 10 in FIGS. 1 and 2 is a floor sweeper of manual type according to the present invention, which includes a casing 11. At a center portion of the hollow space of this casing 11, there are disposed a pair of brooms 12 and 12' of roll brush type, which are longitudinally jaxtaposed in parallel and adjacent to each other. Dust storage chambers 13 and 13' are formed at the front and back end portions of those roll brush brooms 12 and 12'. Corner brush brooms 14 are mounted on the four corners of the casing 11, and a broom stick 15 is attached in a swinging manner to the upper center of the casing 11. Indicated at reference numerals 16 and 17 are protective members of an elastic material, which are attached to the peripheral edge of the casing 11, and opening levers which are made operative, when actuated, to open and close the dust storage chambers 13 and 13', respectively.

Now, two housings 18 and 18' of substantially enclosed type, which constitute the essential portion of the present invention, are juxtaposed to each other at both sides of the casing 11. In each of these housings, there are accommodated pairs of such gear trains as will be described with reference to FIG. 8 and other figures. The construction and assembly of the housings and the gear trains will be described in connection with FIGS. 3A and 3B to 6A and 6B. In the following description, explanation will be made on one of the housings and its gear train since the two housings and their gear trains are made to have substantially the same constructions, respectively.

The housing 18 is composed of generally rectangular plates **18*a* and 18*b*, and the former plate 18*a* is bent at its upper and lower edges while the latter plate 18*b* is bent not only at its upper and lower edges but also at its side edges, as shown. Upon assembly, after the bent portions of the plates 18*a* and 18*b* are fitted on one another, the housing 18 is made into a unitary structure by jointing their two plate members. For this purpose, retaining slots 19 are formed in the plate 18*a*, and retaining strips 20 are formed in corresponding positions of the plate 18*b*. Thus, the jointing process is carried out by inserting the strips 20 into the corresponding slots 19 and then by bending the projecting portions of the strips. The housing 18 thus constructed is retained on a partition, which will be described later, by means of the both ear portions of the plate 18*a* so that it may be fixed in the casing 11.**

Figure 3B:
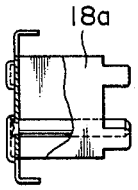
Figure 3A:
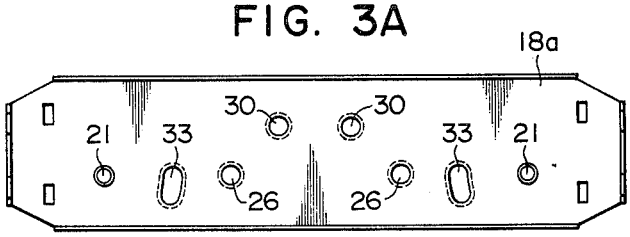
Figure 4B:
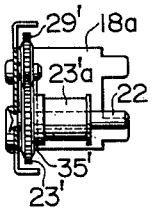
Figure 4A:
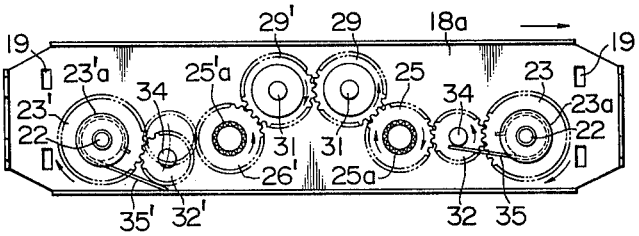
Figure 5B:
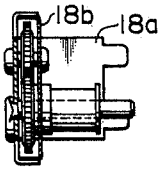
Figure 5A:
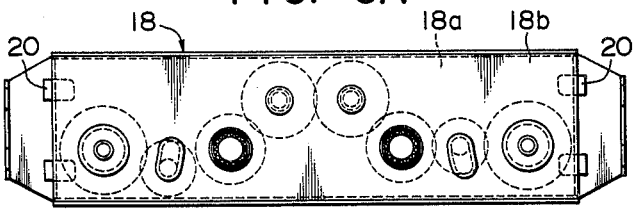
Figure 6B:
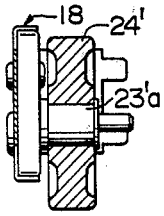
Figure 6A:
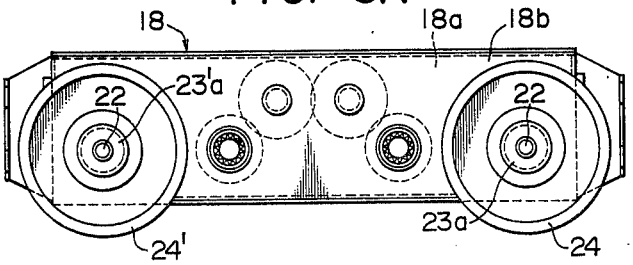

As clearly seen from FIG. 3A, the plate **18*a* is formed with a plurality of paired bores, which are arranged symmetrically with respect to the transverse center line of the floor sweeper 10, while the other plate 18***b* is also formed with a corresponding number of paired bores. Into the through bores 21 which are positioned at the both ends of the plates 18*a* and 18*b*, there are inserted support shafts 22 which support rotatably a first pair of gears or drive gears 23 and 23'. These drive gears are formed integrally with journals 23*a* and 23'*a* which are made to extend inwardly from the housing 18 so as to rotatably support wheels 24 and 24', as shown in FIGS. 6A and 6B. Between the drive gears 23 and 23', there are interposed a second pair of gears or brush actuating gears 25 and 25'. Into blind bores 26 and through bores 27, there are respectively inserted two shafts 28 which in turn support the brush actuating gears 25 and 25', respectively, as clearly seen from FIG. 8. The brush actuating gears 25 and 25' are formed with integral end portions 25*a* and 25'*a*, which are made to extend inwardly from the housing 18. The roll brush brooms 12 and 12' are fitted on those end portions 25*a* and 25'*a*, so that they may rotate as the brush actuating gears 25 and 25' rotate. Between these brush actuating gears 25 and 25', moreover, there are interposed a third pair of gears or coactive gears 29 and 29'. The plate 18*a* is formed with outwardly recessed or blind bores 30 so as to support shafts 31, which in turn support those coactive gears 29 and 29'. These coactive gears are made to mesh not only with each other but also with their adjacent brush actuating gears 25 and 25', so that the drive force from either of the drive gear 23 or 23' may be transmitted to the brush actuating gear 25' or 25 of the opposite side to thereby always ensure synchronous rotations between the two brush actuating gears 25 and 25'. For such alternate power transmission, there are provided a fourth pair of movable gears 32 and 32', which are positioned, respectively, between the drive gear 23 and the brush actuating gear 25 and between the drive gear 23' and the brush actuating gear 25'. The plate 18*a* is formed with slots 33 so as to movably support shafts 34, which in turn support the gears 32 and 32' movably together. These movable gears 32 and 32' are always in meshing engagement with the drive gears 23 and 23' but are made to removably engage with the brush actuating gears 25 and 25'. In accordance with the forward and backward movements of the floor sweeper 10, more specifically, only the movable gear (namely, the gear 32 in FIG. 4A), which is located at a front position in the direction of advance, is in meshing engagement with the brush actuating gear 25, but the movable gear 32' at the rear side is out of meshing engagement with the adjacent brush actuating gear 25'. In this instance, return springs 35 and 35' are attached, respectively, to the drive gears 23 and 23' so as to urge the movable gears 32 and 32' to thereby make feasible the position change of the movable gears in the slots 33. Each of these return springs 35 and 35' is composed of an annular portion, which is elastically fitted on the journal 23*a* or 23'*a*, and of a linear portion which extends from one end of the annular portion. Thus, when the sweeper body is moved in the direction of arrow as shown in FIG. 4A, the spring 35, which is located in the front position in the direction of advance or at the righthand side of the Drawing, is moved upward to push the shaft 34 of the movable gear 32 as the drive gear 23 rotates, so that the movable gear 32 may be moved upward within the slot 33 to be brought into meshing engagement with the brush actuating gear 25. On the other hand, the spring 35', which is located in the rear position in the direction of advance, has the leading end of its linear portion brought into abutment engagement with the bottom wall of the housing 18 as the other drive gear 23' rotates, thus idly rotating on the journal 23'*a*. At the same time, the movable gear 32' is moved downward within the slot 33 to be released from engagement of the brush actuating gear 25'. Under this condition, the rotational drive force of the drive gear 23 is transmitted to the brush actuating gear 25 through the movable gear 32 and further to the rear brush actuating gear 25' through the meshing coactive gears 29 and 29'. As a result, the two roll brush brooms 12 and 12' are made to rotate in the directions to coactively sweep the dust upwardly and inwardly, while the drive gear 23' is allowed to rotate idly. In the case where the sweeper body is moved in the opposite or backward direction, it will be easily understood that the two roll brush brooms 12 and 12' are turned by the drive gear 25' with the other drive gear 25 being allowed to rotate idly.

As has been described in the above, according to the present invention, the gear trains are accommodated in the enclosed housings, the drive force is transmitted to the gear trains from the two wheels which are located in the front position with respect to the direction of advance of the sweeper body, so that the two roll brush brooms may rotate always in the preset directions, that is to say, the front broom may rotate in the direction to sweep in the dust while the rear broom may rotate in the direction to sweep up the dust which have been swept in by the front broom. Since, moreover, these two roll brush brooms are made to rotate always in parallel with the floor to be cleaned, it should be appreciated as an advantage of the present invention that the brooms can reliably sweep up the dust of large and small scales on the floor into the dust storage chamber.

Figure 7A:
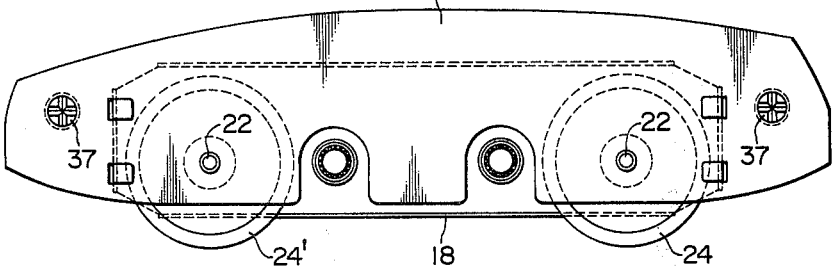
FIGS. 7A and 7B are a side elevation and a fragmentary elevation showing the partition, to which the housing accommodating the gear trains is attached.
Figure 7B:
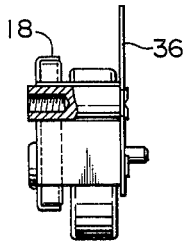
Figure 8:
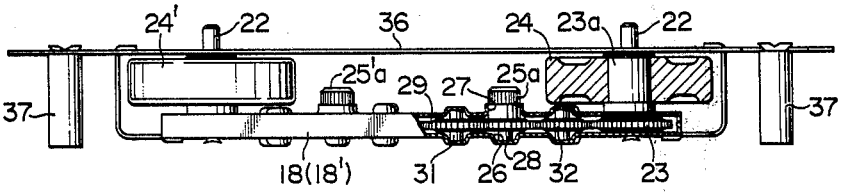
FIG. 8 is a fragmentary top plan view of FIG. 7A.

FIGS. 7A and 7B and 8 show the method, by which the housing 18 or 18' thus constructed is attached to one of partitions 36. As apparent from the Drawing, the housing 18 is fixed to the partition 36 by having its ear portions bent. These partitions 36 are, as seen from FIG. 2, arranged inside of and in parallel with the housings 18 and 18' in a manner to extend longitudinally of the hollow space of the casing 11. Between each of the partitions and each of the housings, there are positioned the front and rear wheels 24 and 24' which are press-fitted on the journals 23*a* and 23'*a* of the respective drive gears 23 and 23'. The support shafts 22 of these wheels are made to extend along the sides of the dust storage chambers 13 and 13'. These dust storage chambers 13 and 13' are made to swing about the respective support shafts 12 for their opening purpose, as will be described in more detail in connection with FIG. 9. Incidentally, reference numeral 37 indicates suspension shafts for the corner brush brooms 14.

Figure 9:
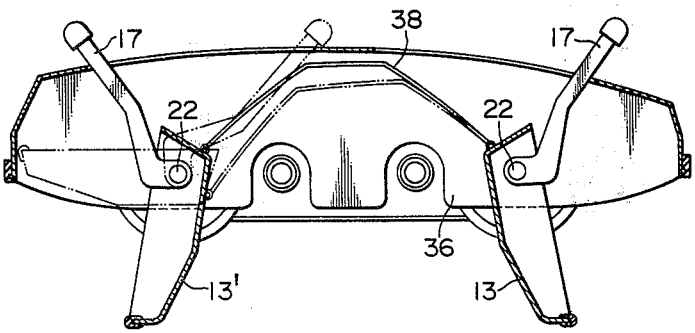
FIG. 9 is a side elevation showing the opening mechanism for the dust storage chambers.

Reference will be made to FIG. 9, in which an opening mechanism for opening and closing the dust storage chambers 13 and 13' by a single action is shown. The opening levers 17 are made to have their one end fixed to the support shafts 22, which extend from the partitions 36 so as to support the drive gears, the wheels and the dust storage chambers 13 and 13', and to have their other end projecting from the casing 11. Indicated at reference numeral 38 are wire springs which are curved and have their respective ends fixed to the dust storage chambers 13 and 13'. Incidentally, the dotted lines designate the dust storage chambers which are in their closed condition. According to the present invention, the dust storage chambers can be opened easily by moving the levers 17, which are made to project from the casing 11, in the directions of arrows of FIG. 1.

As has been described hereinbefore, since the gear trains are accommodated in the enclosed housings, it should be appreciated as an advantage of the present invention that the gears will not be prevented from rotating smoothly by the dust. Since, moreover, two symmetrical movable gears are employed in the gear trains so that the two drive gears located in the front position with respect to the direction of advance of the sweeper body may rotate as a drive power source for the roll brush brooms while the two drive gears in the rear position may rotate idly, it should also be appreciated as another advantage that the sweeper body can run stably on the floor.

Moreover, since the two brush actuating gears are arranged symmetrically and a pair of roll brush brooms of the same diameter are attached to the support shafts of the brush actuating gears so that the brooms may always exert their sweeping actions in parallel to the floor to be swept, it should be appreciated as a further advantage that the floor sweeper of the invention can be free from such drawbacks of inconvenience and inefficiency as are concomitant with the conventional floor sweepers. For example, the drawback in the conventional sweeper using two roll brushes is that one of the roll brushes will float on the floor with little sweeping effect, and the drawback in the sweeper using the combination of large and small roll brushes is that one of the brushes will always sweep in the dust while the other will always sweep up the dust.

Moreover, since the dust storage chambers can be opened and closed by a single action from the upper outside of the casing, it should be appreciated as a further advantage that the disposal of the stored dusts can be accomplished with ease.

Still moreover, since the drive force of the wheels is transmitted to the roll brush brooms by way of the gear trains, it should also be appreciated as a further advantage that reduction in the sweeping performance, which will take place in the conventional sweeper of friction type due to wear of the wheels, can be obviated.

What is claimed is:

1. A floor sweeper of the manual type including a casing having a hollow space therein, a pair of front and a pair of rear wheels rotatable on the floor to be swept, and one pair of roll brush brooms arranged at a center portion of the hollow space of said casing and juxtaposed longitudinally in parallel and adjacent to each other in a manner to rotate inwardly, as said wheels rotate, so as to sweep up the dust on the floor into the hollow space of said casing, wherein the improvement comprises: two substantially enclosed spaced parallel housings one on each side of said casings; a gear train accommodated in each of said housings and including front and rear drive gears positioned in each of said housings coaxially with each pair of said front and rear wheels, front and rear brush actuating gears interposed between said front and rear drive gears supported coaxially with said roll brush brooms, and coactive means interposed between said front and rear brush actuating gears spacing said roll brush brooms and for effecting the inward rotation of said brush actuating gears and accordingly said roll brush brooms; and selective means interposed between said drive gears and said brush actuating gears for selectively effecting power transmission in accordance with the forward and backward movement of said floor sweepers, such that the drive power from the drive gears, which are located at a front position with respect to the direction of advance of said floor sweeper, may be transmitted to the adjacent brush actuating gears by said selective means and to the brush actuating gears of the far side by way of said coactive means, thus allowing the drive gears in the rear position to idle.

2. A floor sweeper according to claim 1, wherein said coactive means includes a pair of front and rear coactive gears meshing with each other and with said front and rear brush actuating gears.

3. A floor sweeper according to claim 1, wherein said selective means includes a pair of front and rear movable gears meshing with said drive gears and selectively meshing with the front and rear bush actuating gears, and spring means mounted on said drive gears for urging said movable gears to bring the same selectively into meshing engagement with said brush actuating gears.

4. A floor sweeper according to claim 3, wherein each of said spring means is composed of an annular portion, which is elastically fitted on the support shaft supporting said drive gears, and of a linear portion which extends from one end of said annular portion to have selective engagement with the shaft supporting said movable gears.

5. A floor sweeper according to claim 1, further comprising front and rear dust storage chambers in the hollow space in said casing and supported by the support shafts of said drive gears.

6. A floor sweeper according to claim 5, further comprising chamber opening mechanism including opening levers each having one end fixed to the support shafts of said dust storage chambers and the other end projecting from said casing, and wire springs formed with curved portions and having their respective ends fixed to said dust storage chambers, whereby said dust storage chambers can be opened by moving said opening levers.

* * * * *